US010780362B2

(12) United States Patent
Ring

(10) Patent No.: US 10,780,362 B2
(45) Date of Patent: Sep. 22, 2020

(54) METHOD AND AN APPARATUS TO IMPROVE THE REALISM OF A MODEL LOCOMOTIVE MOTION AND SOUNDS

(71) Applicant: RING ENGINEERING, INC., Schereville, IN (US)

(72) Inventor: Timothy W. Ring, Schereville, IN (US)

(73) Assignee: RING ENGINEERING, INC., Schereville, IN (US)

( * ) Notice: Subject to any disclaimer, the term of this patent is extended or adjusted under 35 U.S.C. 154(b) by 0 days.

(21) Appl. No.: 16/044,554

(22) Filed: Jul. 25, 2018

(65) Prior Publication Data

US 2019/0030446 A1 Jan. 31, 2019

Related U.S. Application Data

(60) Provisional application No. 62/536,610, filed on Jul. 25, 2017.

(51) Int. Cl.
*A63H 19/10* (2006.01)
*A63H 19/14* (2006.01)

(52) U.S. Cl.
CPC ..... *A63H 19/10* (2013.01); *A63H 19/14* (2013.01)

(58) Field of Classification Search
CPC ..... A63H 19/02; A63H 19/10; A63H 19/14; A63H 19/24
See application file for complete search history.

(56) References Cited

U.S. PATENT DOCUMENTS

| | | | | |
|---|---|---|---|---|
| 3,664,060 | A | 5/1972 | Longnecker | |
| 5,633,985 | A | 5/1997 | Severson et al. | |
| 6,457,681 | B1 * | 10/2002 | Wolf | A63H 19/14 104/296 |
| 6,765,356 | B1 * | 7/2004 | Denen | A63H 19/02 318/6 |
| RE38,660 | E | 11/2004 | Novosel et al. | |
| 7,458,545 | B1 * | 12/2008 | Ricks | A63H 19/18 246/1 C |
| 7,926,427 | B1 * | 4/2011 | Ricks | B61G 7/14 105/1.5 |
| 8,807,487 | B2 * | 8/2014 | Ring | A63H 19/24 246/187 A |
| 8,897,618 | B1 | 11/2014 | Saleh et al. | |
| 9,421,474 | B2 * | 8/2016 | Derby, Jr. | A63H 19/14 |
| 9,449,590 | B1 | 9/2016 | Severson et al. | |
| 2007/0001058 | A1 * | 1/2007 | Severson | A63H 19/32 246/1 R |

* cited by examiner

*Primary Examiner* — Eugene L Kim
*Assistant Examiner* — Alyssa M Hylinski
(74) *Attorney, Agent, or Firm* — AP Patents

(57) ABSTRACT

A method and an apparatus that improves the motion and sounds of a model locomotive such that they more closely represent or simulate that of a real locomotive. The motion and sounds are changed in such a way that it is more realistic when compared to a real locomotive that is pulling a heavy load.

19 Claims, 3 Drawing Sheets

METHOD AND AN APPARATUS TO IMPROVE THE REALISM OF A MODEL LOCOMOTIVE MOTION AND SOUNDS

CROSS-REFERENCE TO RELATED APPLICATIONS

This present nonprovisional application is related to and claims benefit of and priority from U.S. Provisional Patent Application Ser. No. 62/536,610 filed on Jul. 25, 2017, the entire contents of which are hereby incorporated by reference thereto.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BRIEF DESCRIPTION OF THE DRAWINGS

The accompanying drawings are incorporated in and constitute part of the specification and illustrate various embodiments. In the drawings.

DETAILED DESCRIPTION OF EXEMPLARY EMBODIMENTS

Figure 1:
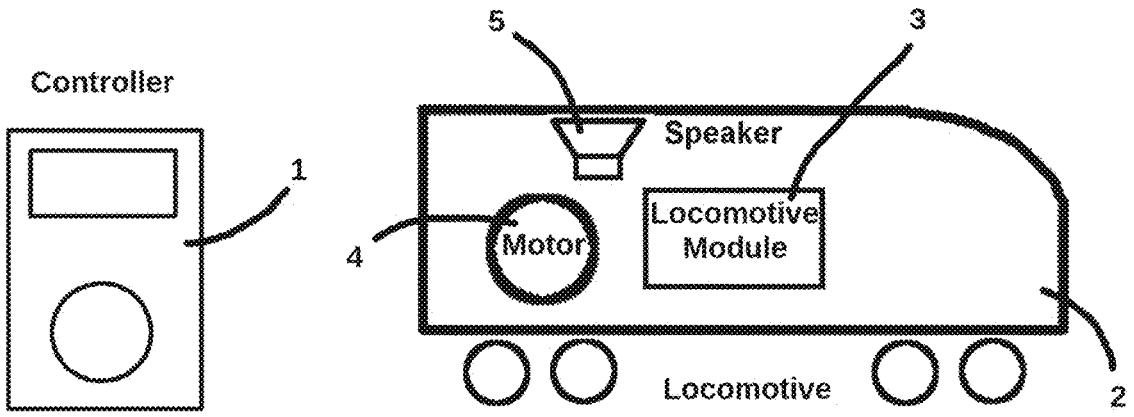
FIG. 1 is an example of a block diagram showing a controller to be used by a person that wants to control a model train Locomotive and the major components of the model train Locomotive.

Prior to proceeding to the more detailed description of the present subject matter, it should be noted that, for the sake of clarity and understanding, identical components which have identical functions have been identified with identical reference numerals throughout the several views illustrated in the drawing figures.

References in the specification to "an embodiment", "an example" and similar phrases mean that a particular feature, structure, or characteristic described in connection with the embodiment or variation, is included in at least an embodiment or variation of the invention. The phrase "in an embodiment", "in an example" or similar phrases, as used in various places in the specification, are not necessarily meant to refer to the same embodiment or the same variation.

Any implementation described herein as "an embodiment", "an example", "illustrative" and similar phrases is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

Unless otherwise noted, the terms and words used in the following description and claims are not limited to the bibliographical meanings, but, are merely used to enable a clear and consistent understanding of the exemplary embodiments. Accordingly, it should be apparent to those skilled in the art that the following description of exemplary embodiments are provided for illustration purpose only and not for the purpose of limiting the invention as defined by the appended claims and their equivalents.

The term "network" refers to a communication path between two or more devices using a previously determined protocol for communication. The network may be based on standards or may be proprietary to a particular embodiment. It may use a variety of physical media, including but not limited to, radio frequency propagation through the air, wire connections, optical communication through the air or through optical fiber, signals coupled to electrical power lines, and magnetically coupled communication.

Furthermore, there is no intention to be bound by any expressed or implied theory presented in the preceding technical field, background, or the following detailed description. It is also to be understood that the specific devices and processes illustrated in the attached drawings, and described in the following specification, are simply examples of the inventive concepts defined in the appended claims. Hence, specific dimensions and other physical characteristics relating to the examples disclosed herein are not to be considered as limiting, unless the claims expressly state otherwise.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

The term "or" when used in this specification and the appended claims is not meant to be exclusive; rather the term is inclusive, meaning either or both.

The particular embodiments of the present disclosure generally provide method and an apparatus directed to controlling the motion and sounds of a model locomotive.

In particular embodiments, an apparatus can comprise a processing device or a controller with one or more electrical circuits that contain the components and instructions necessary to control at least an electric motor and speaker(s) for operation and/or control of model railroad train with a locomotive.

In particular embodiments, the subject matter is directed to model railroading and in particular, model railroading locomotive control and sound production.

In particular embodiments, the method controls the motion and sounds of a model locomotive such that it runs and sounds more like real locomotive.

In particular embodiments, the processing device or a controller comprises an Electrical Circuit 3 that can be located inside a Model Train Locomotive 2 that executes a program (instructions) that cause motion and sounds that more closely simulate those of real trains.

In particular embodiments, the processing device is configured as inclusive or exclusive of static and dynamic friction of the locomotive such that the motor and sounds are controlled in a fashion that more accurately represents a real locomotive moving action and sounds made.

In particular embodiments, sound output is based on a model that uses Static and/or Dynamic Friction and the difference in the User commanded speed and the motor speed. The model generates the motion and/or sounds that are very realistic. The operation is easy for the user. The operator of the model railroad can only set a load value (i.e. number of freight cars connected to the loco) and operate the throttle.

The subject matter improves the control of a model train locomotive such that it more closely represents the running of a real locomotive.

FIG. 1 illustrates a block diagram showing a locomotive 2 of a model railroad at least comprising a locomotive module 3, a motor 4 and at least one speaker 5. FIG. 1 also illustrates a controller 1 configured to be used by a person/user that wants to control a model train locomotive 2 and the major components of the model train locomotive 2. The controller 1 can be networked with the locomotive module 3.

The controller 1 may be provided as a microprocessor based computing device, a computer, a portable device that includes, but is not limited to, a cell phone, a smart phone, a portable personal computer, a pad, or the like.

Figure 2:
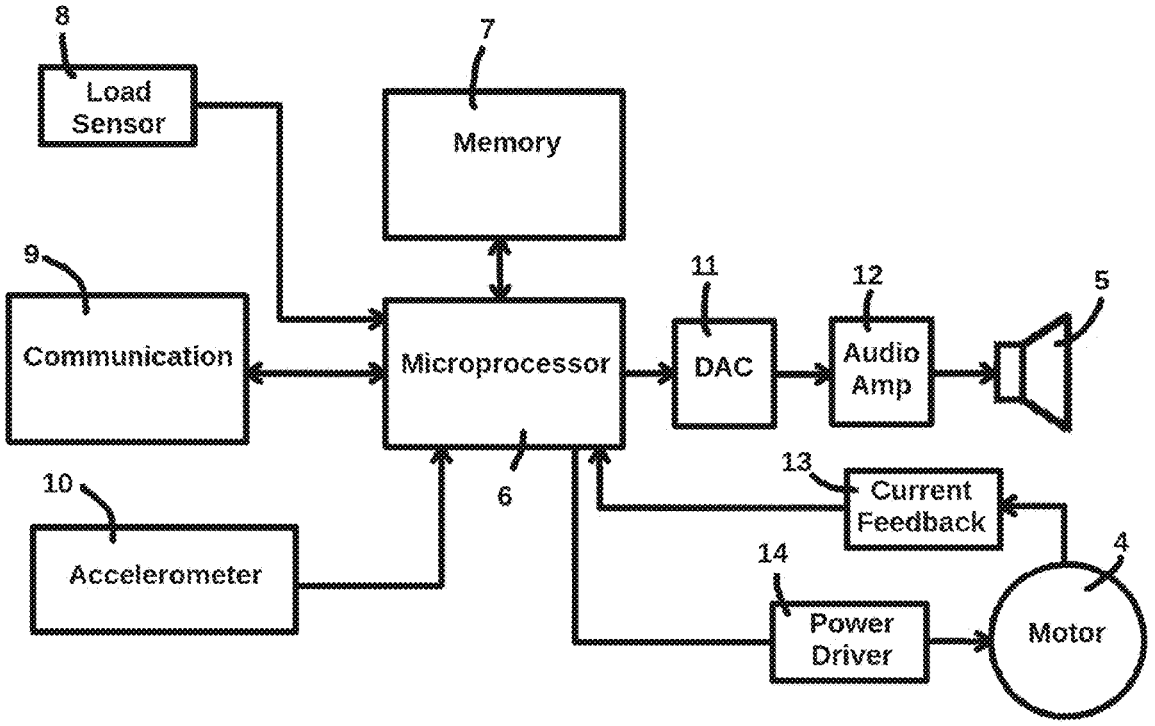
FIG. 2 is an example of a block diagram of components of the model train locomotive.

FIG. 2 illustrates a block diagram of exemplary circuit components of the model train locomotive module (controller) 3. The locomotive module 3 comprises one or more computing devices, for example such as a microprocessor or microcontroller 6. There is a memory 7 that stores computer readable non-transitory computer readable medium that, when placed in operable relation to a computing device, provides software (program) to effect operation and/or control of the locomotive 2, for example such as the method of FIG. 4.

Tangible computer readable medium means any physical object or computer element that can store and/or execute computer instructions. Examples of tangible computer readable medium include, but not limited to, a compact disc (CD), digital versatile disc (DVD), blu-ray disc (BD), usb floppy drive, floppy disk, random access memory (RAM), read-only memory (ROM), erasable programmable read-only memory (EPROM), optical fiber, etc. It should be noted that the tangible computer readable medium may even be paper or other suitable medium in which the instructions can be electronically captured, such as optical scanning. Where optical scanning occurs, the instructions may be compiled, interpreted, or otherwise processed in a suitable manner, if necessary, and then stored in computer memory.

Alternatively, it may be a plugin or part of a software code that can be included in, or downloaded and installed into a computer application. As a plugin, it may be embeddable in any kind of computer document, such as a webpage, word document, pdf file, mp3 file, etc.

The motor 4 and one or more speakers 5 are coupled to and are controlled by the microprocessor 6. The motor 4 can be coupled through a current feedback module 13 and/or power driver module 14. The circuit of the one or more speakers 5 can include the audio amplifier 12 and DAC 11. Optional load sensor 8 and accelerometer 10 (that can be also an inclinometer or any other suitable sensor) can be provided as explained further in this document. Also is shown a communication module 9 that communicates at least with the Controller 1 and that can also have a connection, either wireless or wired, with a network (not shown) for operating the model railroad train.

Figure 3:
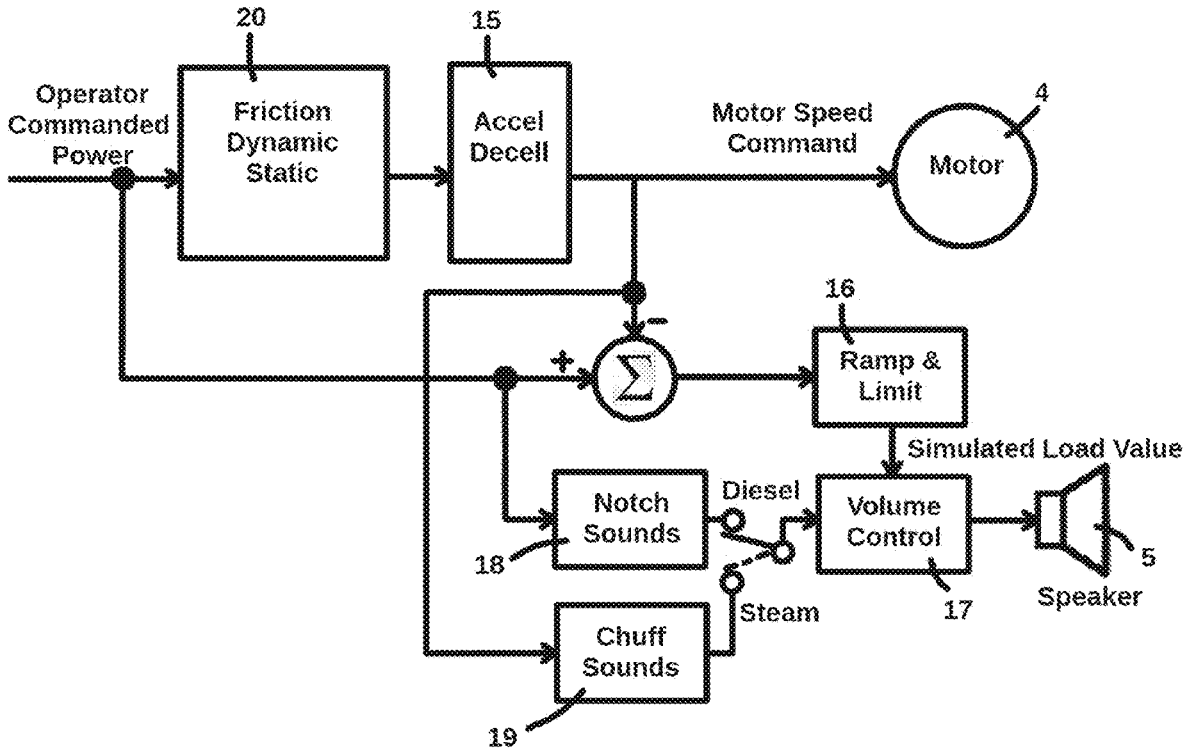
FIG. 3 is an example of a block diagram of components of the model train locomotive module program for controlling motor and sounds.
Figure 4:
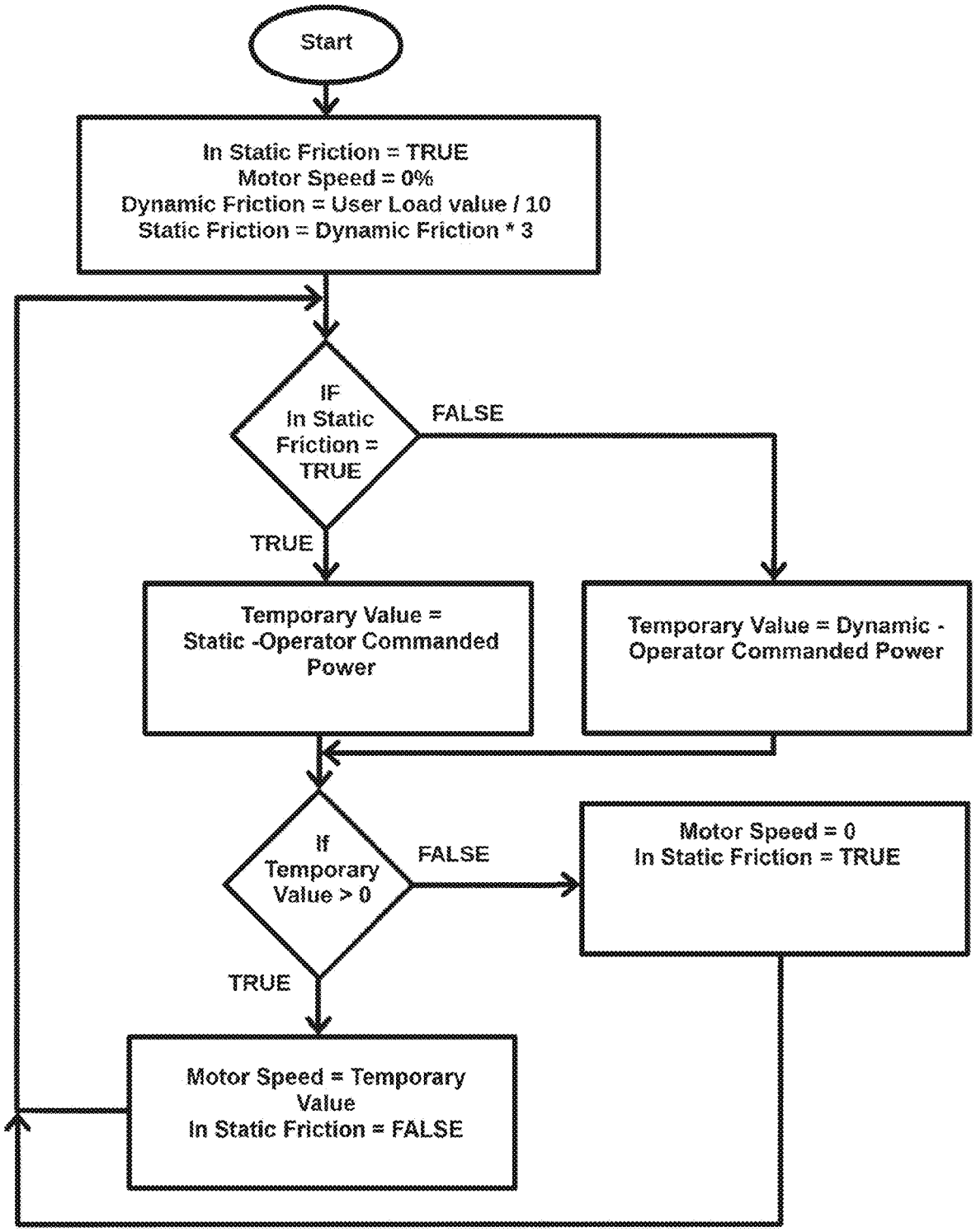
FIG. 4 is an exemplary flow chart of executable instructions to implement static and dynamic friction.

FIG. 3 illustrates a block diagram of exemplary components of the model train Locomotive Module processing logic for controlling motor and sounds and FIG. 4 illustrates a flow chart with an exemplary logic for the program to implement static and dynamic friction.

To make the motor control more realistic, the locomotive module 3 can (or configured to) execute computer instructions so that a model train locomotive 2 can simulate the action of a real train locomotive. A real train locomotive is significantly affected by it static and dynamic friction. A real train's static friction and heavy load often causes the train to not move at all until enough power is applied to overcome that friction. To more accurately simulate this action, a program in a model train locomotive module 3 can implement Static and Dynamic Friction (component/module/instructions) 20 in a program that executes in a microprocessor 6 as a function of the load. Depending on the amount of load, the program can implement different levels of static and dynamic friction in the program to cause a model train locomotive to react more like a real train locomotive. The implementation of static and dynamic friction, along with Acceleration and Deceleration (component/module/instructions) 15, can greatly improve the realism of how a model train locomotive 2 reacts to user control. The following algorithm can be used to simulate static and dynamic friction of a train locomotive.

Four variables within the executable instructions can be used: 'In Static Friction', 'Temporary Result', 'Operator Commanded Power', and 'Motor Speed Command'. Operator Commanded Power can be from 0-100%. The Motor Speed Command is set by the program (executable instructions) stored in the non-transitory memory and executed by Microprocessor 6 using the logic (executable instructions), for example as illustrated in the flow chart of FIG. 4. For example, if the load was set to a maximum level (100%) and the user sets the Operator Commanded Power to 20%, the Locomotive Module 3 would keep the Motor Speed Command at zero percent. Note that the Operator Commanded Power can be used to select the notch (RPM) of the prime mover sounds being played. Therefore, a person can hear the sound of the prime mover increase while the locomotive is not moving, which is how a real locomotive under a heavy load acts. Once the Operator Commanded Power is increased enough to overcome the static friction, the program in the Microprocessor 6 can switch from implementing static friction to implementing dynamic friction on the Motor Speed Command signal per the flow chart in figure The Motor Speed Command can come from the Microprocessor 6 and be sent to the Power Driver 14 and then to the Motor 4. In reality, dynamic friction is always less than the static friction so dynamic friction can be implemented in a similar fashion but with a lower value. If the static friction is set to 30%, then the dynamic friction may be 10%. It can be desirable to get actual data from a locomotive for the static and dynamic friction values that most closely represent the real locomotive. Once the actual motor speed reference gets to zero, the static friction should take back over as shown in the flow chart of FIG. 4. The load can be automatically detected by the Load Sensor 8 or the model train operator can manually set the load value. The load value can be sent from a Controller 1, received through the Communications 9, and saved in Memory 7. When the load is set and the Microprocessor 6 executes the Friction calculation within block 20, the operator only needs to drive the throttle (not shown) to get more realistic train running action.

In existing model train controls, an operator may use a brake feature to simulate static friction and a heavy load. This method to control a locomotive causes the model operator to 1) Operate a brake which would not be done by a real locomotive engineer that was trying to get the train moving and 2) Requires the model operator to constantly turn on and off the brake to simulate the train braking friction each time it starts and stops. Neither of which would be necessary when static and dynamic friction is implemented after setting a load value only once. Microprocessor logic can also implement a brake function but a brake would only be implemented if the model operator wanted to actually apply the brake to stop the model train more quickly.

Because diesel engines can rev up through notches without the locomotive moving, NotchSounds selector part (component/module/instructions) 18 of the instruction set would get a reference to choose the proper notch sound from the Operator Commanded Power signal. For steam locomotive sounds, the reference to the Chuff Sounds 19 selector part of the program would use the Motor Speed Command since the chuff sounds should only play when the motor is running (i.e. the locomotive is moving.) The chuff sounds of a steam locomotive happen because the cylinders move and the cylinders are physically tied to the wheels so chuffs only happen when the wheels are turning.

Since diesel locomotives typically have 8 power notches (levels) Sound samples for each notch can be recorded and stored in Memory 7. The program in Microprocessor 6 can select the proper notch recording to play by evaluating Operator Commanded Power value. Since there is eight notches and the Operator Commanded Power value goes from 0-100% for each 12.5% interval (100% divided by 8=12.5% per notch) the next notch recording can be selected to be played. So if the Operator Commanded Power value is 30% then the Microprocessor 6 can read the notch recording for notch three out of Memory 7 and the digital audio would be converted to analog by Digital to Analog Converter (DAC) 11 then sent to the Audio Amplifier 12 and finally the audio would be played by the Speaker 5. It should be noted that if the train was stopped and the operator increased the Operator Commanded Power value the sound would rev up while the static friction part of the program would keep the Motor Speed Command to zero. This is how a real locomotive sounds when it begins to pull a heavy load. The Prime mover revs up and the train's static friction keeps it from moving until enough power is applied to overcome the static friction.

It is also contemplated herewithin that the sum of the Operator Power Signal and the Actual Motor Reference can be sufficient indication of prime mover load. For example, if a locomotive engineer sets the prime mover to notch eight (Operator Commanded Power>87.5%) and the motors are not spinning, then the prime mover is under a heavy load. The amount of load can be used to adjust the sounds in the fashion of choosing a sound sample to play that was recording under a heavier load or modifying the volume or both. Playing a sound sample that was recorded under a heavy load, or increasing the volume of a sound sample, or both, can make for a more realistic sound. Note that if the Operator Commanded Power is much greater than the Motor Speed Command, then the load is high and positive so the sound output would be high and positive. Conversely, if the Operator Commanded Speed is much lower than the Motor Speed Command, then the load is low and negative (coasting) so the sound output would be lowered which replicates what happens in real locomotives. The output of the summation goes into the code (executable instructions) that Ramps and Limits 16 the result to reasonable values before it is used to adjust the Volume Control 17. The Simulated Load Vale can be summed with the volume value to control the volume of the sound. So if the current sound volume was set by the user to 50% and the Simulated load vale is 20% then the volume can be set to 70% (50%+20%=70%). So as the Simulated Load Value increases, the volume becomes louder and as the Simulated Load Value decreases, the volume will go down. This is how a real locomotive prime mover sounds. As the load increases the sound gets louder and when the load is reduced the sound gets quieter.

Locomotive Prime Mover sounds can be recorded when they are under load and not under load. In an example, a recording can be made with a Prime Mover in Notch three that is not pulling a train (unloaded). In an example, a recording can be made of a Prime Mover in Notch three that is pulling a heavy train. The sound of the Prime Mover changes when it is pulling a train vs when it is not pulling a Train. These recordings can be converted to digital files and stored in Memory 7. The microprocessor 6 can evaluate the Simulated Load Value and when the value is high, it can generate playing the recordings from a locomotive that is under load with the sound outputted by one or more speakers 5. And when the Simulated Load Value is low, then microprocessor 6 can generate playing a recording of a prime mover that was recorded without a load with the sound outputted by one or more speakers 5. It is noted that multiple levels of loads can be recorded, stored in Memory 7, and chosen by the Simulated Load Value. In an example, four recordings can be made for each notch with each of the four recordings per notch taken when the locomotive is pulling a different load. Then depending on Simulated Load Value the Microprocessor 6 can choose the appropriate sound file to play. So if the Simulated Load Value is divided into four equal levels 25% per level (100% divided by 4 levels=25% per level) then if the Simulated Load Value was 100% the Microprocessor 6 would choose the recording of the Prime Mover under full load to be played through the Speaker 5. If the Simulated Load Value is 0% then the microprocessor 6 would choose the recording of the Prime Mover under no load to be played. If the Simulated Load Value was in the middle then the appropriate recording would be played.

The Locomotive Load Value can be set by the model train operator, or measured, or a combination of both. The model train operator can use a Controller 1 and set the load value that can be received by the Communications 9 electronics of the Locomotive Module 3. Further the load can be set by reading the motor Current Feedback 13 because the motor current will increase when the load to the motor is increased. So if a model locomotive 2 is pulling more freight cars, the motor current would increase, and therefore the Locomotive Module 3 can detect the number of cars it is pulling which in turn would set the load that affects the Static and Dynamic values 20 that would ultimately produce a load signal that would affect Volume Control 17.

In an embodiment, a level detector, such as an accelerometer, 10 can be used to detect if the locomotive is on a grade. For example, if the locomotive is on a grade, then the load value can be changed and therefore the static and dynamic friction values can be changed to simulate the effects of real trains while operating on a grade. For example, if the locomotive is trying to begin moving forward on a large uphill grade the static and dynamic friction values can be increased to simulate the more power needed to break free on an uphill grade. Depending on the amount of grade the static and dynamic values can be changed ratio-metrically.

In an embodiment, a load sensor 8 can be used to detect how much force is on the locomotive coupler. Depending on the detected amount of force the microprocessor 6 can modify the value of the Static and Dynamic friction values. So as more train cars are coupled together, the load sensor 8 would detect a higher value and the microprocessor 6 can increase the Static and Dynamic friction values. In an embodiment, the microprocessor 6 can measure the current though motor 4, and use the measured current value to adjust Static and Dynamic friction values. In an example, the current can be measured at the point right before the model train begins to move. The current to actually make movement happen can be a good indication of the number of freight cars that the model train is pulling. The motor will need more current to pull a greater number of connected freight cars. The user can enter a value that can be transmitted from the controller 1 and received through communications 9 into microprocessor 6 and stored in memory 7. The value can be used in addition to the measured pulling force by a Load Sensor 8 to set the Static and Dynamic friction values ratio-metrically. For example, this can allow a user to say if the load of twenty freight cars is detected then the static and dynamic values are set a maximum value. So if the Load Sensor 8 detects half of the twenty freight car load, then the static and dynamic values can be set to half of their maximum values. In an example a user can set the value to ten freight cars. In this example, the Static and Dynamic friction values would be set to maximum values if only a ten freight car load was detected or half of the maximum values if only a five freight car load is detected and so on.

For multiple locomotives in a train (MU'ed or consisted) one or more locomotive modules 3 can implement static and dynamic friction. In an example, the locomotive module 3 can implement Static and Dynamic Friction 20 then send a Motor Speed Command to all the other locomotive modules in the consist. In an example, one locomotive module 3 can implement Static and Dynamic Friction 20 then send a Motor Speed Command to all the other Locomotive Modules 3 in the consist in which the Motor Speed Command is a PWM signal to the motor. In an example, one locomotive module 3 can implement Static and Dynamic Friction 20 then send a Motor Speed Command to all the other locomotive modules 3 in the consist in which the Motor Speed Command is a signal that is used to regulate current in the motor as described, for example, in U.S. Pat. No. 8,807,487 which is incorporated in its entirety by reference thereto.

It is also understood that another way to achieve the invention is to implement Static and Dynamic Friction 20 in controller 1. Controller 1 can send a Motor Speed Command to Locomotive Module(s) 3. To effectively play sounds, a sound reference would need to be transmitted by controller 1 to locomotive modules 3 so the locomotive module(s) 3 can play the proper sounds in addition to a Motor Speed Command.

In an embodiment, the method of controlling sound, for example such as illustrated in FIG. 4, can be implemented in the controller 1, rather than the locomotive module 3 with the inputs communicated from the locomotive module 3 and the output, such as motor load and/or sound level and type communicated from the controller 1 to the locomotive module 3.

The method, for example such as method of FIG. 4, can be written as computer program(s) and can be implemented in general-use digital computers that execute the programs using a computer readable recording medium. In addition, the structure of data used in the method can be written on a computer readable recording medium by using several units. Examples of the computer readable recording medium include magnetic storage media (e.g., ROM, RAM, USB, floppy disks, hard disks, etc.), optical recording media (e.g., CD-ROMs, or DVDs), PC interface (e.g., PCI, PCI-express, WiFi, etc.), etc.

The non-transitory computer-readable recording medium may include program instructions, data files, and data structures, alone or in a combination thereof.

In an embodiment, a model train locomotive comprises a motor; one or more speakers; and a controller comprising one or more processors, and a non-transitory computer readable medium comprising executable instructions that, when executed by the one or more processors, cause the one or more processors to select an audible signal from a library of stored audible signals in a response to motor load value (s), the selected audible signal being outputted by the one or more speakers.

In an example, the motor load value(s) comprise static or dynamic friction values.

In an example, the apparatus further comprises a load detector connected to a coupler, the load detector configured to detect an amount of freight cars the train is pulling to set the static and dynamic friction values.

In an example, the controller is configured to monitor current in the motor to detect an amount of freight cars it is pulling and set static and dynamic friction values.

In an example, the apparatus further comprises a load detector in conjunction with a user set value to set static and dynamic friction values.

In an example, the apparatus further comprises a level sensor to detect if the locomotive was on an incline and vary the static and dynamic friction values to simulate trains going up and down grades.

In an example, the controller is configured to use a summation of a User Commanded Power and Motor Speed Command to select between sound samples recorded from real locomotives under different load conditions.

In an example, the controller is configured to use a summation of a User Commanded Power and a Motor Speed Command to adjust volume of a sound being outputted by the one or more speakers.

In an example, the controller is configured to implement acceleration and deceleration rates in addition to static and dynamic friction to simulate a mass of a real train.

In an example, the controller is configured to control multiple of locomotives disposed in a series in a single train.

In an example, the controller is configured to control a plurality of locomotives in a single train in which one locomotive implements static and dynamic friction then sends a motor control to other locomotives in the single train to effective run at the same speed or pull with same amount of power.

In an example, the controller is configured to implement static and dynamic friction so as to transmit a motor reference and a sound reference to locomotive modules.

In an embodiment, a control module comprises one or more processors and a non-transitory computer readable medium comprising executable instructions that, when executed by the one or more processors, cause the one or more processors to perform the steps of implementing static and dynamic friction in a model train locomotive electronic control module to provide a model train with more realistic movement and sound.

In an embodiment, a control assembly for a model railroad locomotive comprises a motor; a current feedback module coupled to the motor; a power driver coupled to the motor; one or more speakers; a load sensor; an accelerometer; and a controller comprising: one or more processors, and a non-transitory computer readable medium comprising executable instructions that, when executed by the one or more processors, cause the one or more processors to select an audible signal from a library of stored audible signals in a response to motor load value(s), the selected audible signal being outputted by the one or more speakers.

In an embodiment, the above described apparatus and/or method can be configured to use the static and/or dynamic friction to make more realistic motion of the model railroad locomotive and train but without generating a corresponding sound. In this embodiment at least the speaker will be omitted but can be later added. In other words, the circuit and the program can be configured to interface with a later added speaker and speaker auxiliary components, for example such as (DAC) 11 and the Audio Amplifier 12 and also generate a sound, as described above. So, the circuit inputs can have an output dedicated to a speaker and speaker auxiliary components as a plug in module or the speaker 5, (DAC) 11 and the Audio Amplifier 12 can be included in the original circuit but not activated/used by the program. Likewise, the program can be configured to activate the speaker 5 in the future or a program revision can be loaded to activate the speaker.

In an embodiment, a static friction can be simulated by a program in a controller in a model train locomotive to provide motion that is more like a real locomotive. A model train locomotive, comprising: one or more motors and one or more controllers with one or more processors that uses logic that is comprised of a static friction value to limit the power or speed command sent to a motor and a User commanded speed or power. If the user commanded power or speed is lower than the static friction value the motor speed or power is zero. If the user increases the commanded speed or power such that it is higher in value than the Static Friction Value a non zero speed or power command is sent to the motor.

This effectively keeps the loco from moving until the user gets the speed or power setting up higher. A real loco engineer needs to put the prime mover in a certain higher notch to break the static friction of a heavy train before it will move. Sounds can play loaded sounds while the train is not moving because of a large load.

In an example, the motor speed command can be the User Power or Speed value minus the Static Friction Value. (i.e. Static Friction Value is 30%, User Value<30% motor is commanded to 0%. User Value 50% motor value=20% (50% User−30% Static Friction)).

In an example, the static friction value can be a constant in the controller.

In an example, a user can set a variable for the static friction value.

In an example, a user load value may be used to set the static friction value such that a Dynamic Friction value can be equal to the User Load Value divided by 10 and Static friction can be equal to the Dynamic Friction times 3. The load value can be set by the user or be an actual measurement such as monitoring the motor current or monitoring a strain gauge or like that is measuring the pulling force on the coupler.

In an example, when implementing above static friction there can be a difference in the User Commanded Speed or Power and the Speed or Power command to the motor. This difference is effectively the amount of load that the locomotive is currently experiencing and the difference value can be used to play the sounds such that they sound like they are loaded. The difference signal can be used to modify the volume to the speaker. The more load a locomotive is under the louder the prime mover typically sounds. So, increasing the volume can make a model sound more like a real train under load. The difference signal can be used to select different sound samples that were recorded from real locomotives under different load conditions.

In an example, the value sent to the motor can be modified by acceleration and deceleration rates to more accurately create motion like a real locomotive.

In an embodiment, when the static friction value is exceeded, the speed or power value to the motor can be adjusted within a program by a lower value than the Static Friction Value (Dynamic Friction Value) to simulate dynamic friction of a real train in a model train. If the user commanded speed or power is lowered enough such that the motor stops, then the program can execute logic for static friction until once again static friction value is exceeded then once again dynamic friction should be implemented.

In an example, motor speed command can be the User Power or Speed value minus the Dynamic Friction Value. (i.e. Dynamic Friction Value is 10% (always less than static friction value), User Value 50% motor value=40% (50% User−10% Dynamic Friction)).

In an example, the static and/or a dynamic friction value can be a constant in the controller.

In an example, the static friction value can be a constant in the controller.

In an example, a user can set a variable for the static or dynamic friction value.

In an example, a User Load Value may be used to set the static friction value such that a Dynamic Friction value can be equal to the User Load Value divided by 10 and Static friction can be equal to the Dynamic Friction times 3. The load value can be set by the user or be an actual measurement such as monitoring the motor current or monitoring a strain gauge or like that is measuring the pulling force on the coupler.

In an example, the value sent to the motor can be modified by acceleration and deceleration rates to more accurately create motion like a real locomotive.

In an example, when implementing above static and/or dynamic friction there can be a difference in the User Commanded Speed or Power and the Speed or Power command to the motor. This difference is effectively the amount of load that the locomotive is currently experiencing and the difference value can be used to play the sounds such that they sound like they are loaded. The difference signal can be used to modify the volume to the speaker. The more load a locomotive is under, the louder the prime mover typically sounds. So increasing the volume can make a model sound more like a real train under load. The difference signal can be used to select different sound samples that were recorded from real locomotives under different load conditions.

Persons of ordinary skill in the art may appreciate that, in combination with the examples described in the embodiments herein, units and algorithm steps can be implemented by electronic hardware, computer software, or a combination thereof. In order to clearly describe the interchangeability between the hardware and the software, compositions and steps of every embodiment have been generally described according to functions in the foregoing description. Whether these functions are performed using hardware or software depends on particular applications and design constraints of the technical solutions. A person skilled in the art may use different methods to implement the described functions for each specific application. However, such implementation should not be considered as beyond the scope of the present invention.

As will be appreciated by those of ordinary skill in the art, aspects of the various embodiments may be embodied as a system, method or computer program product. Accordingly, aspects of ems may take the form of an entirely hardware embodiment, an entirely software embodiment (including firmware, resident software, micro-code, or the like) or an embodiment combining software and hardware aspects that may all generally be referred to herein as a "server," "circuit," "PC," "module," "auxiliary device," "logic" or "system." Furthermore, aspects of the various embodiments may take the form of a computer program product embodied in one or more computer readable medium(s) having computer readable program code stored thereon.

Any combination of one or more computer readable storage medium(s) may be utilized. A computer readable storage medium may be embodied as, for example, an electronic, magnetic, optical, electromagnetic, infrared, or semiconductor system, apparatus, or device, or other like storage devices known to those of ordinary skill in the art, or any suitable combination of computer readable storage mediums described herein. In the context of this document, a computer readable storage medium may be any tangible medium that can contain, or store a program and/or data for use by or in connection with an instruction execution system, apparatus, or device.

Computer program code for carrying out operations for aspects of various embodiments may be written in any combination of one or more programming languages, including an object oriented programming language, such as Java, Smalltalk, C++, or the like, and conventional procedural programming languages, such as the "C" programming language or similar programming languages. In accordance with various implementations, the program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The flowchart and/or block diagrams in the figures help to illustrate the architecture, functionality, and operation of possible implementations of systems, methods and computer program products of various embodiments. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It should be appreciated that reference throughout this specification to "one embodiment" or "an embodiment" means that a particular feature, structure or characteristic described in connection with the embodiment is included in at least one embodiment of the disclosed subject matter. Therefore, it is emphasized and should be appreciated that two or more references to "an embodiment" or "one embodiment" or "an alternative embodiment" in various portions of this specification are not necessarily all referring to the same embodiment or the same variation. Furthermore, the particular features, structures or characteristics may be combined as suitable in one or more embodiments of the disclosed subject matter.

Similarly, it should be appreciated that in the description of embodiments, various features are sometimes grouped together in a single embodiment, figure, or description thereof for the purpose of streamlining the disclosure aiding in the understanding of one or more of the various inventive aspects. This method of disclosure, however, is not to be interpreted as reflecting an intention that the claimed subject matter requires more features than are expressly recited in each claim. Rather, as the following claims reflect, inventive aspects lie in less than all features of a single foregoing disclosed embodiment. Thus, the claims following the detailed description are hereby expressly incorporated into this detailed description.

Any element in a claim that does not explicitly state "means for" performing a specified function, or "step for" performing a specified function, is not to be interpreted as "means" or "step" clause as specified in 35 U.S.C. § 112, ¶ 6. In particular, any use of "step of" in the claims is not intended to invoke the provision of 35 U.S.C. § 112, ¶ 6.

Anywhere the term "comprising" is used, embodiments and components "consisting essentially of" and "consisting of" are expressly disclosed and described herein."

Furthermore, the Abstract is not intended to be limiting as to the scope of the claimed subject matter and is for the purpose of quickly determining the nature of the claimed subject matter.

What is claimed is:

1. A model train locomotive, comprising:

a motor;

one or more speakers; and a controller comprising:

one or more processors, and a memory with a non-transitory computer readable medium comprising executable instructions that, when executed by said one or more processors, cause said one or more processors to implement a method of simulating a static friction and a dynamic friction of a real train in a model train, said method comprising the steps of:

generating, based on a load value, a motor speed command when a difference between an inputted motor speed value and a value of a static friction is greater than zero and when an "In Static Friction Variable" is set as "TRUE"; and generating, based on said load value, a motor speed command when a difference between an inputted motor speed value and a value of a dynamic friction is greater than zero and when a state of said "In Static Friction Variable" is set as "FALSE" in said memory;

said value of said dynamic friction being smaller than said value of said static friction;

said "In Static Friction Variable" being set as "TRUE" when a motor speed reference value is equal to zero in said memory.

2. The model train locomotive of claim 1, further comprising a load detector connected to a coupler, said load detector configured to detect an amount of freight cars said model train locomotive is pulling so as to set said load value.

3. The model train locomotive according to claim 1, further comprising a current feedback module, wherein said controller is configured to monitor current in said motor to detect an amount of freight cars it is pulling and set said load value.

4. The model train locomotive according to claim 1, further comprising a load detector in conjunction with a user set value to set said load value.

5. The model train locomotive according to claim 1, further comprising a level sensor to detect if said model train locomotive was on an incline, said controller configured to vary static and dynamic friction values to simulate trains going up and down grades.

6. The model train locomotive according to claim 1, wherein said controller is configured to use a summation of a User Commanded Power and Motor Speed Command to select between sound samples recorded from real locomotives under different load conditions.

7. The model train locomotive according to claim 1, wherein said controller is configured to use a summation of a User Commanded Power and a Motor Speed Command to adjust volume of a sound being outputted by said one or more speakers.

8. The model train locomotive according to claim 1, wherein said controller is configured to implement acceleration and deceleration rates in addition to static and dynamic friction to simulate a mass of the real train.

9. The model train locomotive according to claim 1, wherein said controller is configured to control multiple model train locomotives disposed in a series in said model train.

10. The model train locomotive according to claim 1, wherein said model train locomotive comprises a plurality of model train locomotives and wherein said controller being configured to control said plurality of model train locomotives in a single train in which one model train locomotive implements static and dynamic friction then sends a motor control signal to other model train locomotives in the single train to run at same speed or pull with same amount of power.

11. A control module for a model train comprising a locomotive with a motor, said control module comprises one or more processors and a memory with a non-transitory computer readable medium comprising executable instructions that, when executed by said one or more processors, cause said one or more processors to implement a method of simulating a static friction and a dynamic friction of a real train in said model train, said method comprising the steps of:

generating, based on a load value, one motor speed command when a difference between an inputted motor speed value and a value of a static friction is greater than zero and when an "In Static Friction Variable" is set as "TRUE" in said memory; and generating, based on said load value, another motor speed command when a difference between an inputted motor speed value and a value of a dynamic friction is greater than zero and when a state of said "In Static Friction Variable" is set as "FALSE" in said memory;

said value of said dynamic friction being smaller than said value of said static friction;

said "In Static Friction Variable" being set as "TRUE" in said memory when a motor speed reference value is equal to zero.

12. The control module of claim 11, further comprising a communication module, wherein said executable instructions further cause said one or more processors to receive said load value, through said communication module, from a remote device.

13. The control module of claim 11, further comprising an accelerometer, wherein said executable instructions further cause said one or more processors to change said load value in a response to an output signal from said accelerometer.

14. The control module of claim 11, further comprising a current feedback module coupled to the motor.

15. The control module of claim 11, further comprising a power driver coupled to the motor.

16. The control module of claim 11, further comprising a load sensor, said load sensor configured to detect a force on a locomotive coupler, said executable instructions further cause said one or more processors to modify values of said static friction and said dynamic friction.

17. A method of simulating a static friction and a dynamic friction of a real train in a model train, said model train comprising a locomotive with a motor and a control module, said method comprising the steps of:

generating, based on a load value, one motor speed command when a difference between an inputted motor speed value and a value of a static friction is greater than zero and when an "In Static Friction Variable" is set in a memory as "TRUE"; and generating, based on said load value, another motor speed command when a difference between an inputted motor speed value and a value of a dynamic friction is greater than zero and when a state of said "In Static Friction Variable" is set in said memory as "FALSE"; and setting said "In Static Friction Variable" as "TRUE" in said memory when a motor speed reference value is equal to zero said value of said dynamic friction being smaller than said value of said static friction.

18. The method of claim 17, further comprising the step of setting said load value based on one of a motor current feedback and load sensor feedback.

19. The method of claim 17, further comprising the step of inputting, by a user, said load value into said control module.

* * * * *